United States Patent [19]

Malakhov et al.

[11] Patent Number: 4,759,531

[45] Date of Patent: Jul. 26, 1988

[54] METHOD FOR TORCH GUNITING OF A METALLURGICAL UNIT

[75] Inventors: Mikhail V. Malakhov, Moscow; Albert N. Ivoditov; Jury I. Zhavoronkov, both of Cherepovets; Viktor A. Breido, Leningrad; Izrail A. Juzefovsky, Leningrad; Igor P. Tsibin, Leningrad; Alexandr A. Shershnev, Leningrad; Oleg N. Chemeris, Donetsk; Nina P. Chernova, Cherepovets; Vyacheslav F. Badakh, Leningrad, all of U.S.S.R.

[73] Assignee: Vsesojuzny Institut Ogneuporov, Naberezhnay Makarova, U.S.S.R.

[21] Appl. No.: 9,148

[22] Filed: Jan. 30, 1987

[51] Int. Cl.[4] ..... F27D 1/16

[52] U.S. Cl. ..... 266/44; 266/281; 264/30

[58] Field of Search ..... 266/44, 45, 281, 273; 264/30

[56] References Cited

FOREIGN PATENT DOCUMENTS 0334464 3/1972 U.S.S.R. ..... 264/30

0768819 10/1980 U.S.S.R. ..... 266/281

*Primary Examiner*—L. Dewayne Rutledge

*Assistant Examiner*—S. Kastler

*Attorney, Agent, or Firm*—Fleit, Jacobson, Cohn & Price

[57] ABSTRACT

A method for torch guniting of a metallurgical unit, wherein a guniting force formed by a guniting mix, fuel and oxygen is directed into the refractory lining of the unit involved. Simultaneously the guniting torch is exposed in the effect of a wave energy field which is established by virtue of sonic vibrations which are maximally concentrated at the guniting torch.

3 Claims, 2 Drawing Sheets

METHOD FOR TORCH GUNITING OF A METALLURGICAL UNIT

Figure 1:
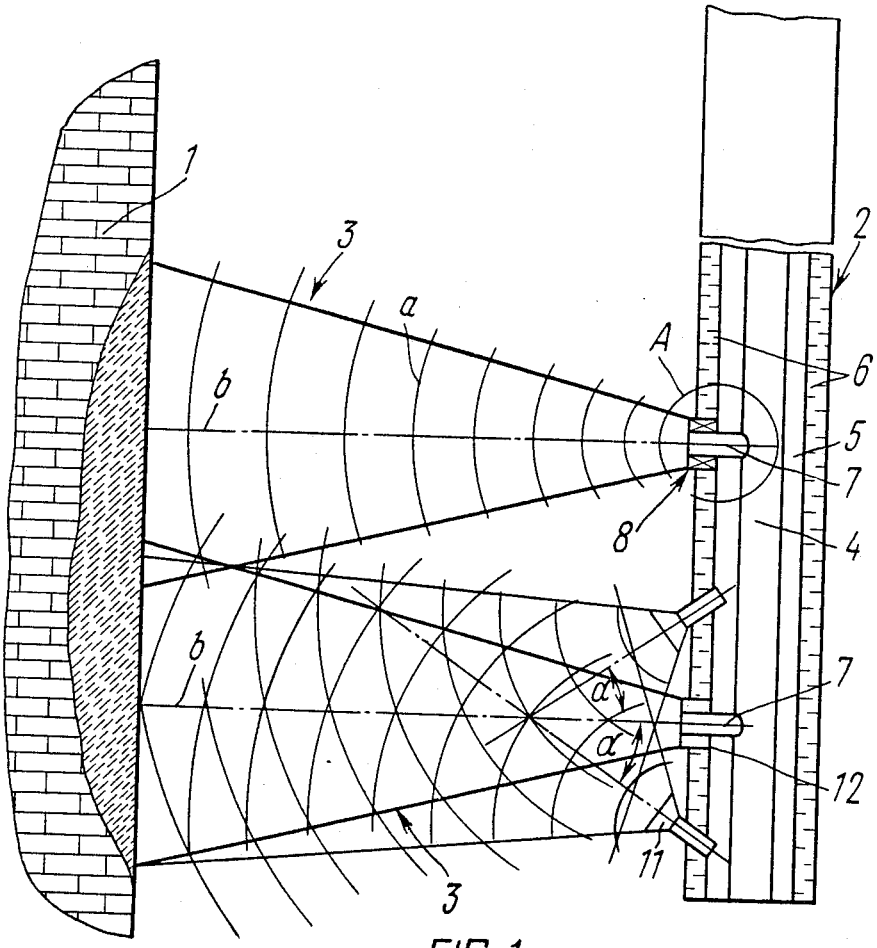

The present invention relates to metallurgical industry and more specifically to methods for torch guniting of metallurgical units.

The invention is most expedient to be applied for repair or reconditioning of the lining of converters, steel-making arc furnaces, open-hearth furnaces, ladles and other steel-making units when under a hot condition.

Known in the present state of the art is a method for guniting the refractory lining of metallurgical units, wherein the gunite mix is fed, via a nozzle, into a torch, whereupon a d.c. electric field is established between the nozzle and the refractory lining to be repaired (cf., e.g., USSR Inventor's Certificate No. 334,464 published on Mar. 30, 1982 in Bulletin No. 12 "Discoveris, inventions, industrial designs and trade marks".

When repairing by said method the particles in the guniting torch are charged with like charges so that electrostatic repulsive forces are partially acting between the like charges during formation of a gunited coating, which results in a lower density of the gunited coating with respect to the base refractory lining and hence in a lower durability of said coating.

There is also known a method for torch guniting of the lining of a metallurgical unit, wherein a guniting torch formed by a guniting mix, fuel and oxygen, is directed onto the refractory lining of the unit, while the guniting torch is exposed to the effect of a wave energy field having a frequency of from 1.0 to 20 kHz.

The wave energy field propagates over the entire interior space of the unit and acts upon the guniting torch located therein (cf., e.g., USSR Inventor's Certificate No. 768,819 published on Oct. 7, 1980 in Bulletin No. 37 "Discoveries, inventions, industrial designs and trade marks").

In the aforesaid method of guniting the wave energy of the field is spread over the entire interior space of the unit so that but a relatively small proportion of it acts upon the guniting torch. Hence inadequate intensification of the burning and heat-exchange processes occurs in the guniting torch due to too low intensity of the field effective therein, with the result that fuel particles have not time enough to burn completely in the course of flight, get embedded in the gunned coating being applied applied and burn down on the surface of the coating and inside it. This in turn increases the porocity (void content) of the gunned coating and hence affects adversely its durability. On the other hand, any increase in the power of a source of the energy field to such an extent that would provide an adequate intensification of the aforesaid processes is not practicable due to a harmful effect of the field upon the metallurgical unit involved and the attending personnel.

It is primary and essential object of the present invention to provide a gunned costing possessing higher durability.

Said object is accomplished due to the fact that in a method for torch guniting of a metallurgical unit, wherein a guniting torch formed by a guniting mix, fuel and oxygen, is directed onto the refractory lining of the unit involved, while the guniting torch is simultaneously exposed to the effect of a wave energy field, according to the invention, said wave energy field is established by virtue of sonic vibrations maximally concentrated at the guniting torch.

It is expedient that sonic vibrations be developed by virtue of an oxygen jet directed along a geometric axis of the torch and passed through an ultrasonic whistle.

Such a way of developing sonic vibrations enables the simplest technical solution of the proposed method to be applied at minimum costs.

It is not less expedient that said sonic vibrations be established by two oxygen jets located on the opposite sides of the geometric axis of the guniting torch, each making up a maximum angle of 50° with said axis, and passed through an ultrasonic whistle.

Such a direction of sonic vibrations makes it possible to embrace the guniting torch in said vibrations to a maximum extent.

It is most expedient that the sonic vibrations be delivered at a minimum field intensity level of 100 dB.

It is at such an intensity that the most complete burning up of fuel particles occurs.

The method for torch guniting of a metallurgical unit carried out in accordance with the present invention, is instrumental in attaining a drastic increase in the durability of the gunned coating by using less cotsly and simplest means.

Figure 2:
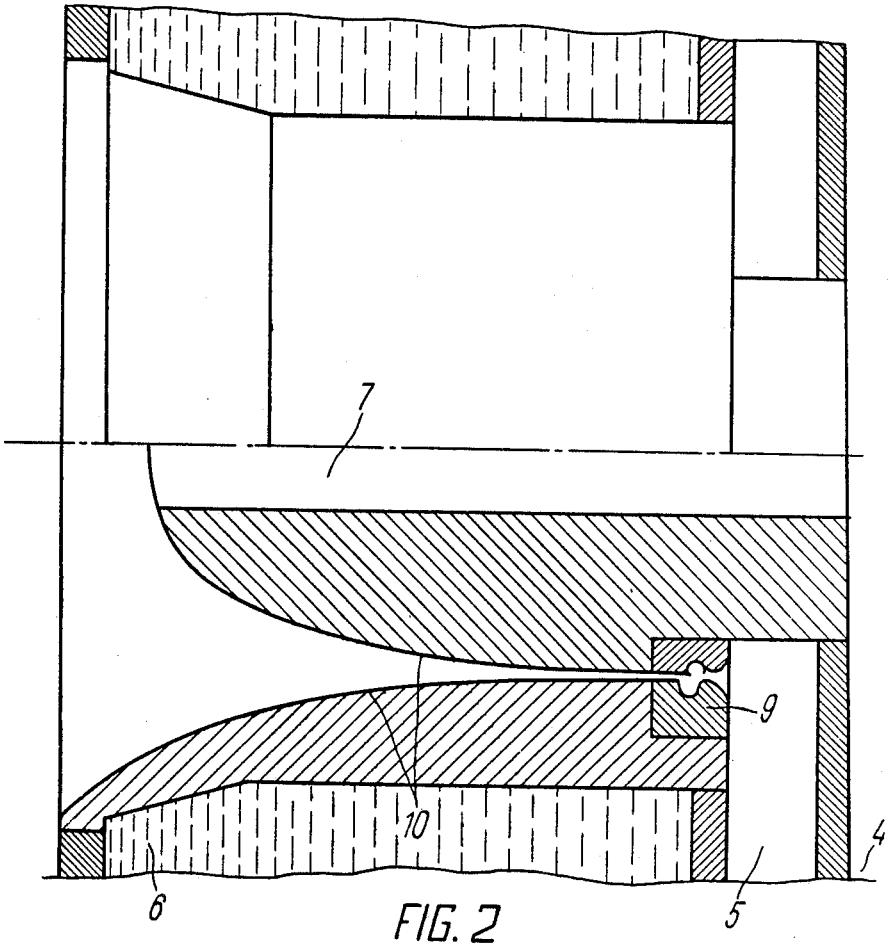

Given below is a detailed description of a specific embodiment of the present invention with reference to the accompanying drawings, wherein:

FIG. 1 illustrates o tuyere and refractory lining of a metallurgical unit, showing two versions of arrangement of ultrasonic whistles; and FIG. 2 is a scaled-up view of a unit A in FIG. 1.

The method for torch guniting of a metallurgical unit consists in that a guniting torch 3 is directed from a tuyere 2 onto a refractory lining 1 (FIG. 1) of the metallurgical unit (omitted in the drawing), and said torch is simultaneously exposed to the effect of an energy field established by virtue of sonic vibrations 'a' which are maximally concentrated at the guniting torch 3. The tuyere 2 comprises coaxially arranged a piping 4 for feeding the guniting mix and fuel, a piping 5 for oxygen supply and a piping 6 for coolant supply. The piping 4 has a nozzle 7 for the guniting mix and fuel, while the piping 5 is provided with a nozzle 8 for oxygen to admit. According to a first embodiment, the nozzle 8 is made up of an ultrasonic whistle 9 (FIG. 2) and a flare 10. In said embodiment sonic vibrations are established by an oxygen jet discharging along a geometric axis 'b' (FIG. 1) of the guniting torch through the ultrasonic whistle 9 (FIG. 2).

According to another embodiment, sonic vibrations are created by two oxygen jets passing through ultrasonic whistles 11 (FIG. 1) which are arranged on the opposite sides of the geometric axis 'b' of the guniting torch 3 and at a maximum angle $\alpha$ of 50° thereto. The ultrasonic whistle 11 is substantially similar to the whistle 9, the sole difference being in that its central portion is solid, since the guniting mix and fuel are passed through the nozzle 7, while a major part of oxygen, through the nozzle 12.

The proposed method of torch guniting was tested on converters of an iron-and-steel works. For guniting use was made of routine two-component guniting mix, comprising a refractory and a fuel component. The guniting process was carried out with the converter in a vertical position. Once steel and slag had been discharged the tuyere 2 was brought into the converter and the guniting mix started to be fed through the nozzle, while oxygen, through the nozzle 12. Additional oxygen jets were fed through the ultrasonic whistles 11 arranged on both sides of the nozzles 7 and 12.

The oxygen jets, while passing through the whistle 11, oscillate the sonic vibrations directed at an angle of 30° to the axis 'b' of the guniting torch 3.

The process of fuel combustion is accompanied by evolution of some volatiles which, while burning up, wrap around the fuel particles, thus impeding access of oxygen thereto. As a result, intensive burning of the fuel particles occurs after said volatiles have burned up. When the guniting torch 3 is exposed to the effect of concentrated sonic vibrations, the energy of the resultant acoustic field is high enough for the gaseous medium volatiles and the solids to oscillate, thus facilitating oxygen ingress to the fuel particles and intensifying the combustion process in the guniting torch. The fuel particles burn up while in flight, which reduces drastically the void content of the lining obtained. On the other hand, the volatiles pass over the refractory particles, which improves the heat exchange process in the guniting torch and, along with the lower void content, upgrades the gunned lining obtained. Use of additional oxygen jets for establishing sonic vibrations makes it possible to attain an adequate power of said vibrations without any further sources of energy and without loss of oxygen, since oxygen fed in the additional jets is also engaged in the fuel burning process.

There have been carried out comparative tests of the known methods with the herein-proposed method for torch guniting of metallurgical units, the results of said tests being tabulated below.

TABLE

| Item No 1 | Guniting method 2 | Intensity level, dB 3 | Rate of wear of lining $mg/cm^2 \cdot s$ 4 | Remarks 5 |
|---|---|---|---|---|
| 1 | According to USSR Inventor's Certificate No. 334,464 (d.c. electric field) | — | 30.2 | High void content lining is applied |
| 2 | According to USSR Inventor's Certificate No. 768,819 (wave energy field) | — | 20.4 | Field energy spread over the entire unit, the field utilization efficiency being as low as 2 percent |
| 3 | According to the method of the invention (sonic vibrations maximally concentrated at the guniting torch) | 100<br>110<br>120<br>130<br>140<br>150<br>165 | 15.1<br>10.2<br>9.6<br>8.9<br>6.3<br>6.2<br>6.4 | High-quality gunned lining is applied |

As can be seen from the data tabulated above exposure of the guniting torch to the effect of concentrated sonic vibrations featuring a minimum field intensity of 100 dB provides for application of a high-quality lining. The rate of wear of the lining deposited by the proposed method is more than twice as low as the rate of wear of the linings applied according to the heretofore-known methods. It is also evident from the aforementioned table that application of gunite linings is most efficient under the effect of sonic vibrations having an intensity level ranging within 140 and 165 dB.

What is claimed is:

1. A method for torch guniting of a metallurgical unit, wherein a guniting torch is formed by igniting a guniting mix, fuel and oxygen, and directing said torch onto the refractory lining of the unit involved, while exposing the guniting torch to sonic vibrations, wherein said sonic vibrations are produced by directing an oxygen jet along the geometric axis of the guniting torch and passed through an ultrasonic whistle.

2. A method for torch guniting of a metallurgical unit, wherein a guniting torch is formed by igniting a guniting mix, fuel and oxygen, and directing said torch onto the refractory lining of the unit involved, while exposing the guniting torch to sonic vibrations wherein said sonic vibrations are produced by two oxygen jets arranged on the opposite sides of the geometric axis of said guniting torch, each of said jets making up a maximum angle of 50° with said axis, by passing said oxygen jets through ultrasonic whistles.

3. A method as claimed in claim 1, wherein said sonic vibrations are delivered at a minimum field intensity level of 100 dB.

* * * * *